US005621505A

United States Patent [19]

Kobayashi et al.

[11] Patent Number: 5,621,505

[45] Date of Patent: Apr. 15, 1997

[54] DEVELOPING APPARATUS HAVING ROTATABLE DEVELOPER SUPPLY MEMBER FOR DEVELOPER CARRYING MEMBER

[75] Inventors: Yoshiaki Kobayashi, Souka; Keishi Osawa, Yokohama; Yoshito Mizoguchi, Kawasaki, all of Japan

[73] Assignee: Canon Kabushiki Kaisha, Tokyo, Japan

[21] Appl. No.: 624,200

[22] Filed: Apr. 3, 1996

Related U.S. Application Data

[63] Continuation of Ser. No. 280,796, Jul. 26, 1994, abandoned.

[30] Foreign Application Priority Data

Jul. 27, 1993 [JP] Japan ..... 5-204562
Jul. 29, 1993 [JP] Japan ..... 5-207225

[51] Int. Cl.[6] ..... G03G 15/09

[52] U.S. Cl. ..... 399/274

[58] Field of Search ..... 355/251, 253, 355/259; 118/656–658

[56] References Cited

U.S. PATENT DOCUMENTS

| | | | |
|---|---|---|---|
| 4,760,422 | 7/1988 | Seimiya et al. . | |
| 5,030,996 | 7/1991 | Tajima et al. | 355/246 |
| 5,075,728 | 12/1991 | Kobayashi et al. . | |
| 5,086,728 | 2/1992 | Kinoshita | 355/259 X |
| 5,220,129 | 6/1993 | Nishio et al. | 355/251 X |
| 5,287,150 | 2/1994 | Kinoshita et al. . | |
| 5,311,263 | 5/1994 | Suzuki et al. | 355/251 |
| 5,311,264 | 5/1994 | Kinoshita | 355/259 |
| 5,353,104 | 10/1994 | Kato | 355/251 X |

FOREIGN PATENT DOCUMENTS

| | | |
|---|---|---|
| 0349326 | 1/1990 | European Pat. Off. . |
| 42-23910 | 11/1967 | Japan . |
| 0016736 | 1/1988 | Japan . |
| 0225263 | 9/1988 | Japan . |
| 0181352 | 7/1993 | Japan . |

OTHER PUBLICATIONS

"*Patent Abstracts of Japan*", vol. 7, No. 224, Jul. 9, 1983, p. 227, Shizuo, Y., Electrostatic Latent Image Developing Device.

"*Patent Abstracts of Japan*,"vol. 17, No. 600, Jul. 23, 1993, p. 1637, Masahide, K., Developing Device.

"*Patent Abstracts of Japan*", vol. 13, No. 530, Aug. 31, 1989, p. 966, Kenichiro, W., Developing Device.

"*Patent Abstracts of Japan*", vol. 15, No. 262, Apr. 10, 1991, p. 1222, Katsuaki, K., Electro–photographic Device.

"*Patent Abstracts of Japan*", vol. 17, No. 242, Dec. 17, 1992, p. 1535, Kenichiro, W., Formation of Developer Thin Layer and Device Thereof.

"*Patent Abstracts of Japan*", vol. 17, No. 262, Jan. 8, 1993, p. 1541, Tamatsu, S, Developing Device.

"Patent Abstract of Japan", vol. 17, No. 305, Feb. 5, 1993, p. 1554, Kenichiro, W., Developing Device.

"Patent Abstract of Japan,"vol. 17, No. 515, Hiroharu, S., May 28, 1993, p. 1614, Developing Device.

*Primary Examiner*—Matthew S. Smith

*Attorney, Agent, or Firm*—Fitzpatrick, Cella, Harper & Scinto

[57] ABSTRACT

A developing apparatus includes a developer carrying member for carrying a magnetic developer. The developer carrying member is provided with a plurality of magnetic poles. The apparatus also includes a regulating member for regulating the layer thickness of the developer on the developer carrying member, and an elastic rotatable member, disposed upstream of a developer regulating position of the regulating member with respect to a movement direction of the developer carrying member, for supplying the magnetic developer onto the developer carrying member. A surface of the elastic rotatable member is composed of unicellular foamed material.

27 Claims, 4 Drawing Sheets

DEVELOPING APPARATUS HAVING ROTATABLE DEVELOPER SUPPLY MEMBER FOR DEVELOPER CARRYING MEMBER

This application is a continuation of application Ser. No. 08/280,796, filed Jul. 26, 1994, now abandoned.

FIELD OF THE INVENTION AND RELATED ART

The present invention relates to a developing apparatus of an electrophotographic or electrostatic recording type or the like such as a copying machine, a printer, a facsimile machine or the like.

In an image forming apparatus such as a copying machine, a printer, a facsimile machine or the like, a latent image is formed on an image bearing member comprising an electrophotographic photosensitive member and an electrostatic recording member or the like, and the latent image is visualized into a toner image by a development operation of a developing device. As an example of such a developing apparatus, various dry type developing apparatus for use with one component developer, have been proposed and put into practice. However, it is very difficult to form a thin layer of one component developer on a developer carrying member. In view of the recent demand for sharp and high resolution of images, a method and an apparatus for forming the thin layer of the toner capable of forming a better thin layer are particularly desired. In response, various measures have been proposed.

For example, it has been proposed to form a thin layer of the toner supplied with proper triboelectric charge on a developing sleeve having a smooth surface with relatively smooth pits and projections provided by blasting with regular particles, by the use of a magnetic blade disposed with a gap therefrom, for a magnetic one component toner.

When a toner of smaller particle size and having a low melting point, is used for the purpose of obtaining a higher image quality and a quicker start of the copy operation, the blocking tends to occur adjacent the magnetic blade because such toner is more easily agglomerated as compared with conventional toner. For this reason, under a high humidity condition, the formed images may involve non-uniformity or fog; and under a low humidity condition, the toner are agglomerated and deposited locally on the developing sleeve due to electric charge-up of the toner, with the result of blotch, which may appear on the resultant image, in some cases. As a countermeasure, Japanese Patent Application Publication No. 16736/1985 or the like proposes that an elastic blade of rubber, resin material or metal is lightly contacted to the developing sleeve, and the toner agglomerated and deposited on the developing sleeve is removed by the contact area (so-called elastic blade system), so that a uniform thin layer of the toner is formed. In addition, the top part and bottom part of the toner layer on the developing sleeve can be sufficiently and uniformly charged through the triboelectricity because of the triboelectric charge application by the blade. As a result, satisfactory images can be provided without non-uniformity, fog or the like.

However, when the elastic blade is used, when repeating the copying operation, agglomerated toner, large size toner, dust or other foreign matters are sandwiched in the nip between the blade and the developing sleeve. They stagnate in the nip. As a result, the toner is not applied on the developing sleeve at such a position, and a white stripe appears on the image corresponding to that position.

When the contact pressure of the elastic blade to the developing sleeve is high, and the melting point of the toner is low, the fusing of the toner to the blade occurs with such repeated copying operations. As a result, non-uniform regulation by the blade, insufficient triboelectric charge application to the toner from the blade, and non-uniform triboelectric charge application, occur with the result that the image is plagued by non-uniformity, fog, and insufficient image density. The phenomenon occurs when uncharged fresh toner is supplied to the neighborhood of the sleeve immediately after the fresh toner is replenished.

SUMMARY OF THE INVENTION

Accordingly, it is a principal object of the present invention to provide a developing apparatus in which developer blocking adjacent a magnetic blade is prevented.

It is another object of the present invention to provide a developing apparatus in which a developer is not fused on a blade.

According to an aspect of the present invention, there is provided a developing apparatus, comprising: a developer carrying member or carrying a magnetic developer, the developer carrying member being provided with a plurality of magnetic poles; a regulating member for regulating the layer thickness of the developer on the developer carrying member an elastic rotatable member, disposed upstream of a developer regulating position of the regulating member with respect to a movement direction of the developer carrying member, for supplying the magnetic developer onto the developer carrying member; wherein a surface of the elastic rotatable member is of unicellular foamed material.

According to another aspect of the present invention, there is provided a developing apparatus comprising: a developer carrying member for carrying a magnetic developer; a regulating member for regulating the thickness of a layer of the developer on the developer carrying member; a first magnetic pole in the developer carrying member, disposed substantially opposed to the regulating member; a second magnetic pole which is disposed first upstream from the first magnetic pole with respect to a movement direction of the developer carrying member; an elastic rotatable member press-contacted to the developer carrying member at a position upstream of the first magnetic pole and downstream of the second magnetic pole with respect to the movement direction.

According to a further aspect of the present invention, there is provided a developing apparatus comprising: a developer carrying member for carrying a magnetic developer; a plurality of magnetic poles in the developer carrying member; and a developer supplying rotatable member for supplying the magnetic developer onto the developer carrying member, wherein the supply rotatable member is disposed adjacent a position where a magnetic confining force on the developer carrying member is a local minimum.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the preferred embodiments of the present invention will be described.

Figure 5:
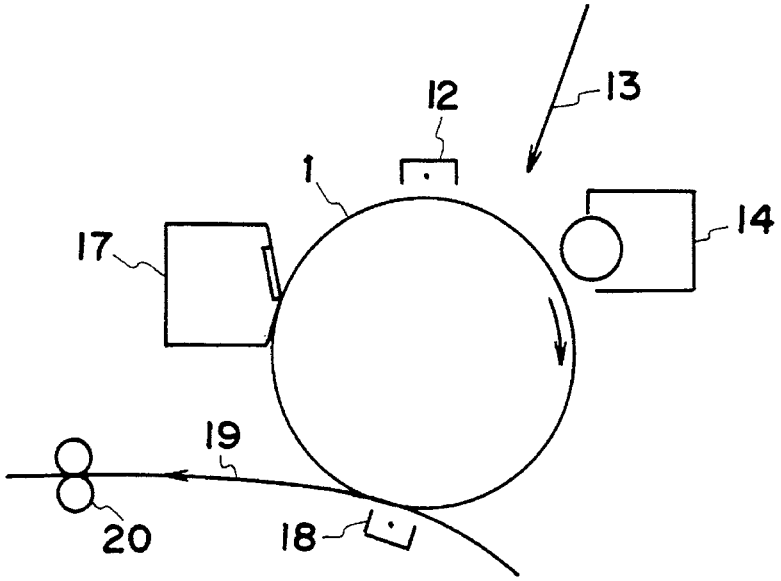
FIG. 5 is a schematic view of an image forming apparatus.

FIG. 5 is a sectional view of an image forming apparatus of an electrophotographic type using a developing apparatus according to an embodiment of the present invention. It comprises a rotatable electrophotographic photosensitive member 1 in the form of a drum including an electroconductive base member coated with a photoconductive layer, the photosensitive member 1 functioning as an electrostatic latent image bearing member. The photosensitive drum 1 is uniformly charged by a charger 12, and thereafter, it is exposed to first information signal 13 by a light emitting element such as a laser, so that an electrostatic latent image is formed. The latent image is visualized into a toner image by a developing device 14. The visualized image is transferred onto a transfer sheet 19 by a transfer charger 18. The transferred image is fixed by an image fixing device 20. The residual toner remaining on the photosensitive drum is removed by a cleaning device 17.

Embodiment 1

Figure 1:
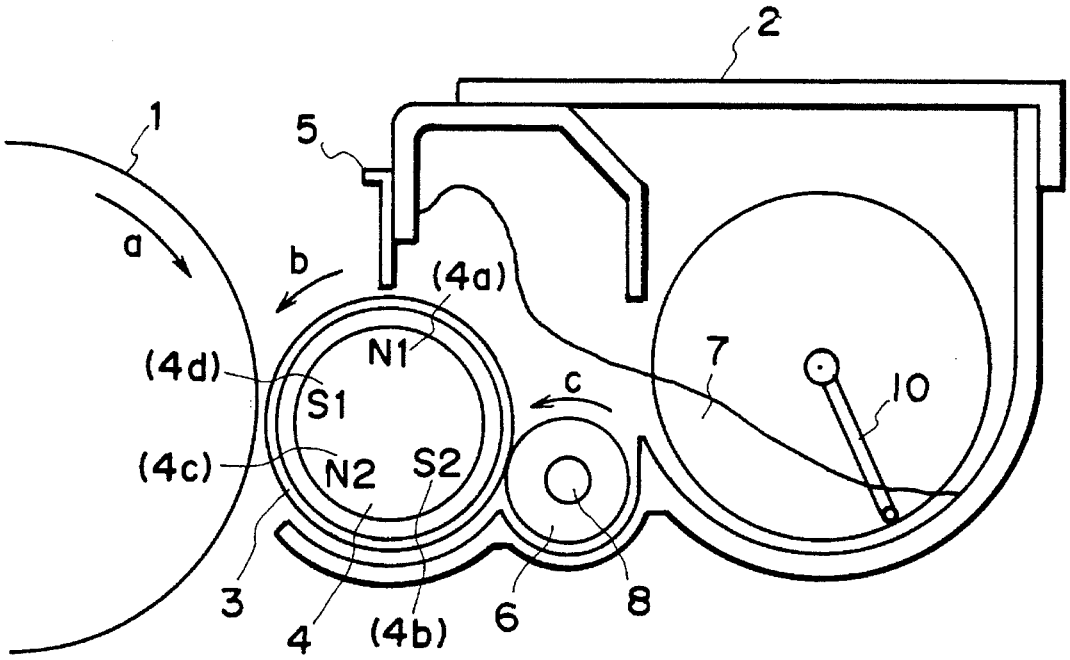
FIG. 1 is a sectional view of a developing apparatus according to a first embodiment of the present invention.

FIG. 1 is a sectional view of a developing apparatus used with the image forming apparatus of FIG. 5.

In FIG. 1, in a developer container 2 containing a magnetic toner 7 as a one component developer, there is provided a developing sleeve 3 as a developer carrying member disposed opposite to a photosensitive member 1 as an image bearing member rotatable in a direction indicated by an arrow a. The developing device functions to develop the electrostatic latent image on the photosensitive member 1 into a toner image. In the developing sleeve 3, there is provided a magnet 4 as a magnetic field generating means having a plurality of magnetic poles *4a, 4b, 4c* and *4d*.

The photosensitive member 1 may be a so-called xerography photosensitive member for forming thereon an electrostatic latent image through a Curlson process, for example, a photosensitive member having a surface insulative layer for forming an electrostatic latent image thereon through a so-called NP process as disclosed in Japanese Laid-Open Patent Application No. 23910/1967, an insulative member for forming thereon an electrostatic latent image through an electrostatic recording process, an insulative member for forming an electrostatic latent image thereon through an image transfer process, or another member for forming thereon an electrostatic latent image (including potential latent image) through another proper process.

The developer container 2 is provided with an opening extending in a longitudinal direction of the developing apparatus (perpendicular to the sheet of the drawing), and the developing sleeve 3 is disposed in the opening.

The developing sleeve 3 is of aluminum or SUS or the like. Substantially a right half peripheral surface (in the Figure) of the developing sleeve 3 is within the developer container 2, and the left half thereof is exposed to the outside of the developer container 2 and is opposed to the photosensitive member 1. It is rotatably supported. Between the developing sleeve 3 and the photosensitive member 1, there is provided a small gap. The developing sleeve 3 is rotated in a direction indicated by an arrow b which is opposite from the rotational direction of the photosensitive member 1.

The developer carrying member is not limited to a hollow cylindrical member such as the developing sleeve 3 described above, but it may be in the form of a rotatable endless belt. Alternatively, it may be in the form of an electroconductive rubber roller.

Magnet 4 is disposed in the developing sleeve 3. It is a stationary permanent magnet, and is not rotated even when the developing sleeve 3 is rotated, thus generating stationary magnetic field.

In the developer container 2 and above the developing sleeve 3, a magnetic blade 5 is provided as a developer regulating member, having an edge close to the surface of the sleeve 3. Upstream of the magnetic blade 5 with respect to the rotational direction of the developing sleeve 3, a toner supply roller 6 of unicellular foamed rubber material is disposed, and is rotatable.

In the developing device 14, the magnetic toner 7 is supplied onto a supply roller 6 by a stirring rod 10, and the supply roller rotates in a direction indicated by an arrow c. By the rotation of the supply roller 6 and the magnetic field provided by the magnet in the developing sleeve 3, the magnetic toner is supplied to the neighborhood of the developing sleeve 3. At a nip formed between the developing sleeve 3 and the supply roller 6, the magnetic toner 7 is rubbed with the supply roller 6 and the developing sleeve 3, so that the toner is triboelectrically charged to a sufficient extent. By the electrostatic force thereby and the magnetic force provided by the magnet in the developing sleeve 3, the toner is deposited on the developing sleeve 3. A description will be provided hereinafter as to the behavior in the contact portion between the supply roller 6 and the developing sleeve 3.

With the continued rotation of the developing sleeve 3, the magnetic toner deposited on the developing sleeve 3 escapes from the magnetic confining portion in the gap between the magnetic blade 5 and the developing sleeve 3, and a thin layer of the magnetic toner 7 is formed on the developing sleeve 3. The layer is carried to a developing zone where the developing sleeve is disposed opposed to the photosensitive member 1 with a small gap. By application of an alternating voltage in the form of a DC biased AC voltage as a developing bias between the developing sleeve 3 and the photosensitive member 1, the magnetic toner 7 is transferred from the developing sleeve 3 onto the electrostatic latent image of the photosensitive member 1 in the developing zone, thus visualizing the latent image into a toner image.

The magnetic toner 7 remaining on the developing sleeve 3 without being consumed for the development in the developing zone, is collected back into the developer container 2 through a bottom portion of the developing sleeve 3. The collected toner 7 is scraped off the developing sleeve 3 at a contact portion between the supply roller 6 and the developing sleeve 3. Simultaneously, by the rotation of the supply roller 6, fresh magnetic toner 7 is supplied onto a developing sleeve 3, and the fresh magnetic toner is fed to the neighborhood of the magnetic blade 5 with the rotation of the developing sleeve 3.

Figure 2:
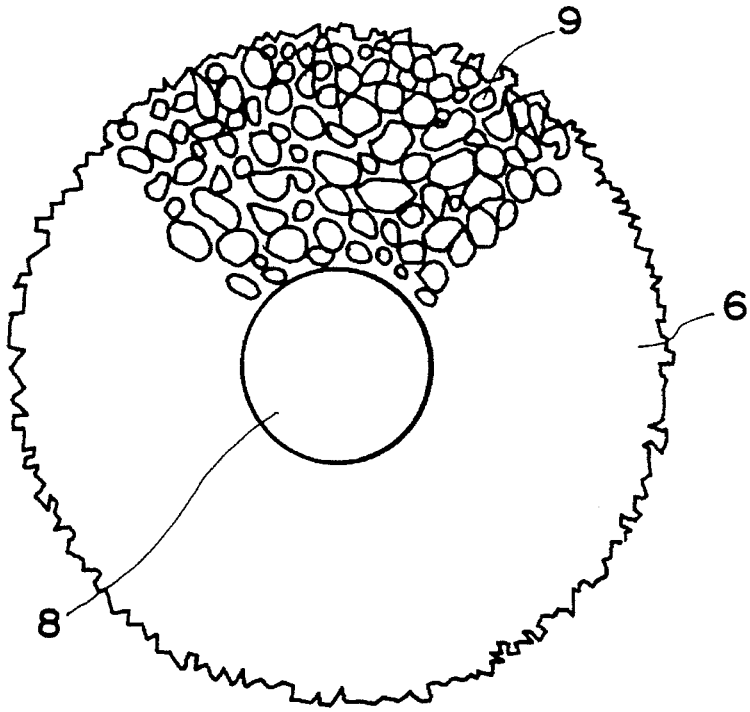
FIG. 2 is a sectional view of a unicellular toner supply roller according to the first embodiment.

Most of the magnetic toner thus removed is mixed with the toner already in the developer container 2 with rotation of the supply roller 6, and therefore, the electric charge of the scraped toner is dispersed. A detailed description will be provided as to the combination of the toner supply roller of unicellular foamed rubber material and the magnetic blade. FIG. 2 is a schematic sectional view of the supply roller in this embodiment. As shown in FIG. 2, it comprises a core metal 8, and a unicellular foamed material of silicone rubber, EPDM rubber, CR rubber, neoprene rubber or the like, in which a wall of a cell 9 does not communicate with any adjacent cells. It is rotated in a direction C in FIG. 1, and is in sliding contact with the developing sleeve. As compared with an open cell roller or a far brush roller, the surface thereof is dense, and therefore, the effective contact area is increased even if the entrance distance into the developing sleeve is the same. Therefore, by the use of the supply roller of the unicellular foamed rubber material (unicellular roller) 6, toner application onto the developing sleeve 3 and the toner scraping therefrom, are much improved.

The improvement is enough to completely prevent the blotch which appears when the magnetic blade is used without the unicellular roller.

Additionally, the toner is triboelectrically charged to a sufficient extent at a contact portion between the unicellular roller 6 and the developing sleeve 3, and the charge can be sufficiently retained. For this reason, the insufficiency of the triboelectric charge application to the toner at the regulating portion as compared with the elastic blade when the magnetic blade 5 is used as the regulating member, can be compensated for by the effect of the unicellular roller 6, and therefore, the amounts of the triboelectric charge are equivalent.

Since the roller 6 is made of unicellular material, the toner is not packed into the roller 6, and therefore, hardening of the roller, wearing, damage or the like due to long term operation, can be avoided, and therefore, the function of the roller can be maintained stably for a long term.

Furthermore, even if foreign matter is introduced into the contact area with the developing sleeve, the foreign matter is quickly moved out of the contact area due to the proper degree of unsmoothness provided by the cells on the surface of the roller and the rotation thereof. For this reason, a white stripe or the like on the developing sleeve occurring in an elastic blade system does not occur. The proper degree of unsmoothness on the surface improves the toner conveying performance, and therefore, the fusing of the toner on the roller surface or the developing sleeve surface can be prevented.

Figure 3:
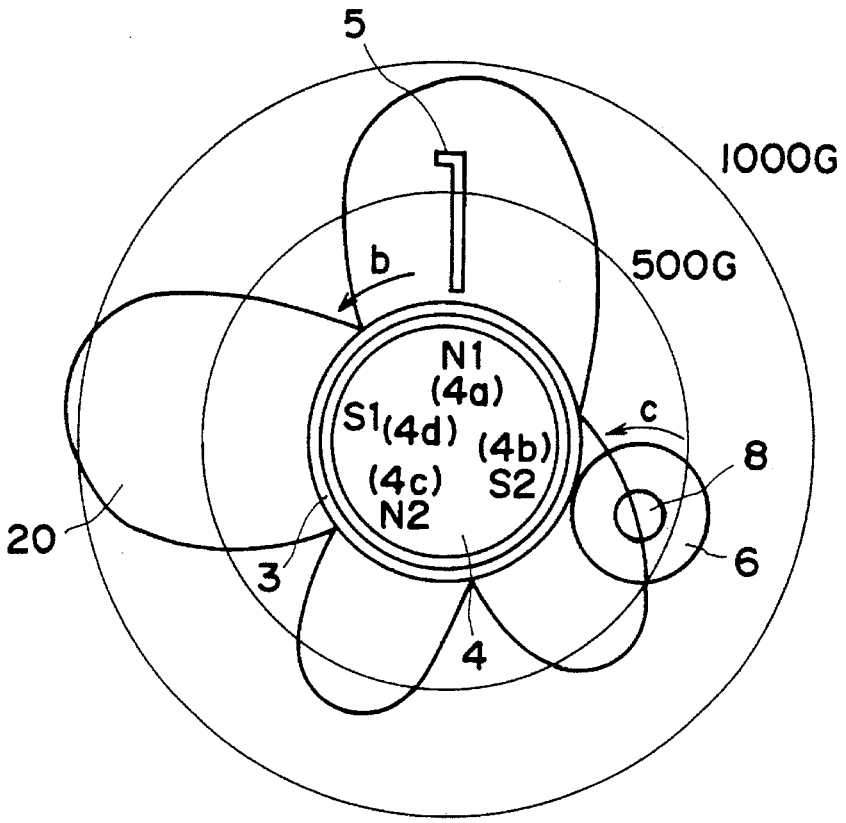
FIG. 3 is an enlarged sectional view of the neighborhood of a contact portion of the unicellular roller in a developing apparatus used in an image forming apparatus according to a third embodiment.

A detailed description will be provided as to the positional relationship between the unicellular roller and the magnet in the developing sleeve. FIG. 3 schematically shows the relationship among the developing sleeve, the magnetic blade and the unicellular roller in the embodiment.

As shown in FIG. 3, a magnetic pole N1 (4*a*) of the magnet 4 in the developing sleeve 3 is substantially opposed to the magnetic blade 5, and functions to form a thin layer of the magnetic toner on the developing sleeve 3. A magnetic pole S1 (4*d*) of the magnet is substantially opposed to the photosensitive member and functions to retract fog toner or scattered toner from the photosensitive member back to the sleeve during the developing operation. A magnetic pole S2 (4*b*) of the magnet 4 functions to prevent leakage of the toner from the developer container. The shown magnetic flux density distribution 20 is that in a direction of the radius of the sleeve, provided by the magnetic poles of the magnet 4. The toner particles are formed into chains of the magnetic particles i.e., a magnetic brush adjacent the local maximum positions of the magnetic flux density.

The neighborhood of the local maximum point of the magnetic flux density corresponds to the position of the associated one of the magnetic poles, where the toner is introduced to the surface of the developing sleeve 3 by the magnetic force. The magnetic pole N1 (4*a*) is substantially opposed to the magnetic blade 5, where the toner is packed relatively dense, and therefore, fresh toner from a hopper which is not electrically charged, is not introduced into that portion. Most of the fresh toner is easily moved toward the developing sleeve adjacent the magnetic pole S2 (4*b*) in the developer container. When the amount of the toner is large, this phenomenon does not easily occur. However, in the low humidity condition with an extremely small amount of the toner, this phenomenon occurs with the result that the uncharged toner is presented for development, and therefore, a foggy background, a density decrease and density non-uniformity occur.

In consideration of the above, the unicellular roller 6 is disposed between the magnetic pole N1 (4*a*) and the magnetic pole S2 (4*b*), and it is rotated in the direction C in FIG. 3 to rub with the developing sleeve 3.

By doing to, even if uncharged fresh toner is taken up by the magnetic pole S2 (4*b*), the toner is triboelectrically charged to a sufficient extent by the contact area between the unicellular roller 6 and the developing sleeve, and therefore, a foggy image, a density decrease or density non-uniformity do not occur.

Using this embodiment, a durability test is carried out under a low humidity condition, and the amount of the toner is decreased in the extreme and then the toner is replenished. At this time, the fog is measured by a reflection density meter, which was available from TOKYO DENSHOKU CO., LTD., Japan. Then, the differences are measured between the reflection ratio of a fresh transfer sheet and a reflection ratio of a solid white portion after the image transfer. Without the unicellular roller, the difference was 4.0% in the worst case. In the case of the developing device of this embodiment in which the unicellular roller 6 is disposed between the magnetic pole N1 (4*a*) and the magnetic pole S2 (4*b*), it was 1.5% even in the worst case. It is added that if the reflection ratio difference is not less than 4%, the background fog is observable to the naked eye, and therefore, the image quality is not good.

As regards the image density, the image density decreases from 1.4 to 1.25 by toner replenishment in the developing device without the unicellular roller. However, in the developing device having the unicellular roller 6 disposed between the magnetic pole N1 (4*a*) and the magnetic pole N2 (4*b*) according to this embodiment, the image density remains 1.4 even after the toner replenishment.

Even in a durability test run under the severe conditions described above, fog, a density decrease or a density non-uniformity hardly occur, and therefore, good images can be maintained.

When the position of the unicellular roller 6 and the position of the magnetic pole N1 (4*a*) are close with each other, the magnetic pole N1 (4*a*) is substantially opposed to the magnetic blade 5, and therefore, the toner is packed at a high density. Therefore, by the rotation of the unicellular roller 6, the rotation of the unicellular roller 6 tends to agglomerate the toner between the magnetic blade 5 and the unicellular roller 6 with the result that the toner deteriorates through long term copying operations, and therefore, a density decrease and fog are produced, thus deteriorating the image quality.

For this reason, the positional relationship among the unicellular roller 6, the magnetic pole N1 (*4a*) and the magnetic pole S2 (*4b*) is preferably such that the unicellular roller 6 is away from the magnetic pole N1 (*4a*) position upstream with respect to the rotational direction of the sleeve, and therefore, is close to the magnetic pole S2 (*4b*).

Through experiments of the inventors, it has been confirmed that the above-described problems do not arise when the unicellular roller 6 contacts the sleeve at a position between a position slightly deviated downstream with respect to the rotational direction of the sleeve from the neighborhood of a local maximum of the magnetic flux density distribution of the magnetic pole S2 (*4b*) in the radial direction of the sleeve and the neighborhood of a position where the magnetic flux density distributions of the magnetic pole N1 (*4a*) and the magnetic pole S2 (*4b*) in the radial direction of the sleeve cross each other.

A description will be provided as to the contact condition of the unicellular roller in the above-described system in which the layer thickness of the toner on the developing sleeve is regulated with the magnetic blade using the magnetic field provided by the magnet in the developing sleeve, and the application of the toner and the scraping of the toner relative to the developing sleeve is carried out using the unicellular roller.

The inventor's experiments have revealed the following. As compared with the tolerable range in a system not using the effect of the magnetic roller (particularly in the case where non-magnetic toner is used), the present invention is advantageous in that the toner application using the magnetic force, toner scraping using the difference of the magnetic forces on the developing sleeve surface is possible by the effect of the magnet roller, and therefore, the tolerance range is wide. In view of these advantages, the following ranges are preferable:

1. Contact width relative to the sleeve: 0.5–6.0 mm
2. Density of the roller: 0.15–0.35 g/cm$^3$
3. Roller hardness (Asker C, 300): 8–30 degrees
4. Number of cells on the roller surface: 100–400/inch As regards the contact width, if it is smaller than 0.5 mm, non-uniform coating on the sleeve occurs, and if it is larger than 6.0 mm, the toner fusing onto the sleeve and a driving torque increase arise. As regards the roller hardness, if it is smaller than 8 degrees, the sleeve is easily contaminated by low molecular weight oil seeping out of the roller, and if it is larger than 30 degrees, the toner fusing onto the sleeve and the driving torque increase occur due to excessive contact pressure. The same applies to the roller density and the number of cells on the roller surface.

In this embodiment, the unicellular roller comprises a metal core having an outer diameter of 8 mm and the unicellular material thereon. The unicellular material had a hardness of 12 degrees (Asker C., 300 gf), a density of 0.25 g/cm$^3$, a number of cells of 200/inch. It was made of neoprene foamed rubber having a thickness of 4 mm and an outer diameter of 16 mm. The relative speed against the developing sleeve was 80 mm/sec, and the contact width was 4.0 mm.

A description will be provided of other structural members.

In the surface of the developing sleeve, a proper degree of unsmoothness is formed to improve the toner conveying property. In the developing apparatus not using the unicellular roller of this invention, the unsmoothness, namely the pits and projections, can not be too fine from the standpoint of preventing a reduction of the toner conveying power and prevention of the occurrence of a blotch due to the local abnormal charging up of the toner on the developing sleeve. As a result, a fog appears in the image due to the insufficiency of the triboelectricity under a high humidity condition or the like. However, according to the present invention, the function of the unicellular roller is such that the blotch is assuredly prevented even if the surface roughness of the sleeve is made fine, and the mechanical deposition force of the toner onto sleeve is enhanced, and therefore, the conveying performance does not decrease. For this reason, the pits and projections of the sleeve surface can be made finer for the purpose of enhancing the triboelectric charge application. The proper surface roughness is provided by sandblasting treatment with irregular alundum abrasive grain or with regular glass beads so as to provide a surface roughness Rz of 1–5 μm. Alternatively, the use may be made of electroconductive particles such as metal oxide, graphite, carbon or the like capable of providing projections by itself to form projections on the surface of the developing sleeve, and the particles providing the projections are bound by binder resin such as phenol resin, fluorine resin or the like so that the surface of the binder resin is provided with pits, by which the roughened surface of the developing sleeve is provided.

In this embodiment, the developing sleeve is an SUS sleeve having a diameter of 20 mm, and the surface is blast-treated with regular glass beads (#400) to provide a surface roughness Rz of approx. 1.5 μm.

The magnetic toner 7 is a magnetic one component developer and comprises magnetic material such as ferrite or the like dispersed in a thermoplastic resin material such as styrene resin, acrylic resin, polyethylene resin or the like. In this embodiment, the toner used is powder comprising copolymer of styrene/acrylic resin and styrene and butadiene resin materials and magnetic materials in which the average particle size is 8 μm. In the powder, 0.5% of colloidal silica is added.

The developing apparatus using the above-described unicellular roller is incorporated in a copying machine NP-2020 available from Canon Kabushiki Kaisha, Japan, and the bias voltage used was an AC voltage having a frequency of 1800 Hz and a peak-to-peak voltage of 1300 V, biased with a DC voltage of −300 V. The surface potential of the latent image on the photosensitive drum 1 had a potential of −700 V at the dark portion and −150 V at the light portion. The gap between the developing sleeve 3 and the photosensitive drum 1 was 300 μm, so that so-called non-contact development was carried out. As a result, the uniform thin toner layer could be formed on the developing sleeve in good order, and the resultant image had a reflection density of 1.4. The amount of electric charge of the toner at this time was +15 μC/g, which was satisfactory.

Additionally, 100,000 sheets are subjected to the image forming operation while replenishing the toner for each 2000 sheets. The operations are carried out continuously. It has been confirmed that good image quality has been maintained without blotch non-uniformity, a density decrease or the like until the last image formation, including the tuner replenishing periods.

Embodiment 2

A developing apparatus according to a second embodiment will be described referring back to FIG. 3. In this embodiment, the magnetic flux densities of the magnetic poles N1 (4*a*) and S2 (4*b*) are particular densities.

In order to produce a magnetic confining force in the gap between the magnetic blade 5 and the developing sleeve 3 for the purpose of forming a thin layer of the magnetic toner 7 on the developing sleeve 3, the magnetic flux density is to be high to some extent. It has been found that if the magnetic flux density of the magnetic pole S2 (4*b*) is higher than that of the magnetic pole N1 (4*a*), the toner retaining force of the magnetic pole S2 increases with the result of toner stagnation between the unicellular roller and the magnetic pole S2 even to the extent that the toner drops from the bottom of the developing device. The reason is considered as follows. The toner feeding force of the unicellular roller 6 is added to the toner retaining force provided by the magnetic pole N1, and the toner conveying property is determined by the interrelation with the toner retaining force provided by the magnetic pole S2. The problem has been solved by making the magnetic flux density of the magnetic pole S2 (4*b*) equivalent to or smaller than the magnetic flux density of the magnetic pole N1 (4*a*).

In this embodiment, the magnetic flux density of the magnetic pole N1 (4*a*) is approx. 1000 Gauss, and that of the magnetic pole S2 (4*b*) is approx. 700 Gauss. The same durability test run as in the first embodiment was carried out. It has been confirmed that good images without blotches, density non-uniformity, fog, a density decrease or the like are produced until the end of the test run.

The surface roughness of the unicellular roller is varied in a certain range, and it has been confirmed that the toner dues not fall from the bottom of the developing device, and toner stagnation does not occur.

Embodiment 3

A developing apparatus according to a third embodiment will be described.

In this embodiment, the material of the unicellular foamed roller as the toner supply roller is so selected that the triboelectric charge property thereof is opposite from that of the charging polarity of the toner used. With this structure, the triboelectric charge application to the toner at the rubbing portion between the developing sleeve and the supply roller and in addition, the Coulomb force for depositing to the supply roller the non-consumed toner returning to the developing device is increased, so that the scraping power is enhanced. This is particularly effective to prevent the occurrence of fog when the copying operation is started after it is kept under a high humidity condition for a long period.

In this embodiment, the toner uses styrene-acrylic resin material having the positive charging property. The unicellular foamed material roller is made of silicone rubber having the negative charging property which is opposite from that of the toner.

Embodiment 4

Referring back to FIG. 3, an image forming apparatus according to a fourth embodiment will be described.

In this embodiment, the positional relationship between the contact portion between the unicellular roller and the developing sleeve and the magnetic pole of the magnet in the developing sleeve is set in a particular way to further improve the function of the unicellular roller.

As shown in FIG. 3, at least one magnetic pole (4*a*) is disposed between the position where the magnetic blade 5 and the developing sleeve 3 are close with each other and a contact position between the unicellular roller 6 and the developing sleeve 3, and preferably, no magnetic pole is substantially opposed to the contact portion between the unicellular roller 6 and the developing sleeve 3. With this structure, the magnetic force in the radial direction of the developing sleeve by the magnetic pole of the magnet in the developing sleeve is small adjacent the contact portion between the unicellular roller and the developing sleeve, and therefore, the toner deposition force relative to the developing sleeve is small, thus facilitating the scraping of the toner by the unicellular roller. In addition, the density of the toner layer is higher than the toner constituted to chains directly above the magnetic pole, and therefore, the statistics and the performance of the triboelectric charge application to the toner which is one of the features of the unicellular roller, is improved. By the provision of at least one magnetic pole between the position where the magnetic blade is close to the sleeve and the position where the roller contacts the sleeve, the toner supply to the unicellular roller and the toner conveying force onto the developing sleeve are improved, thus faithfulness of the solid black image is further improved.

Embodiment 5

Figure 4:
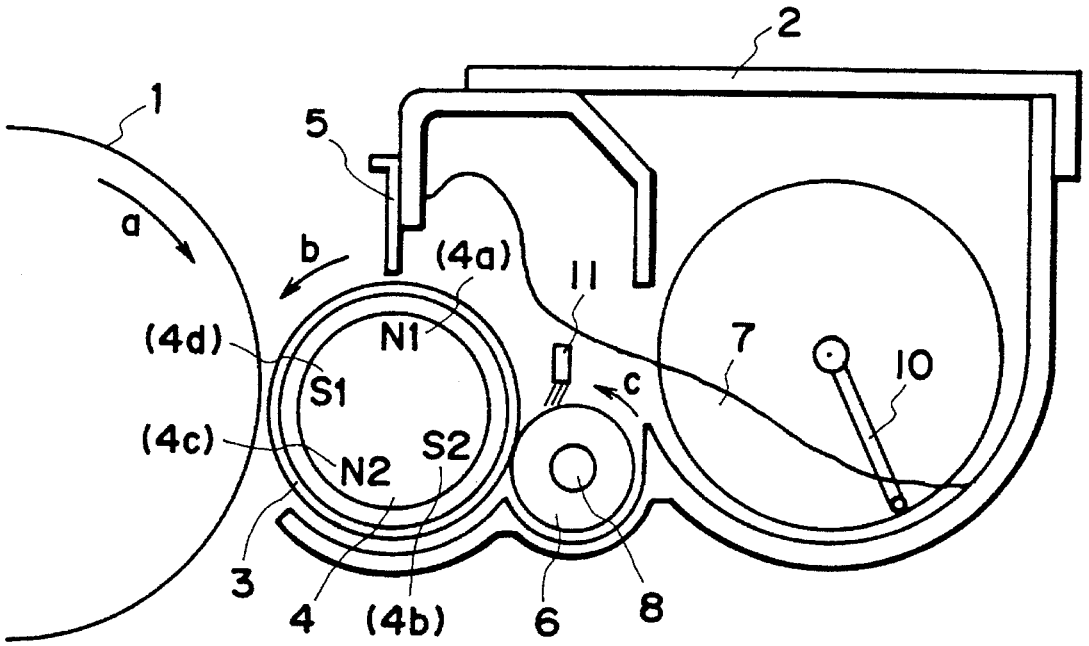
FIG. 4 is a sectional view of a developing apparatus of an image forming apparatus according to a fifth embodiment of the present invention.

Referring to FIG. 4, a developing apparatus according to a fifth embodiment will be described.

In this embodiment, as shown in FIG. 4, there is provided a scraping member 11 lightly contacted to the surface of the toner supply roller.

As described hereinbefore, the unicellular foamed rubber roller does not suffer from packing of the toner therein, because of the structure per se. However, when several tens thousand sheets are processed using fine toner having a particle size of not more than 6 μm, the fine toner may be deposited on the surface with the result that the function of the toner is slightly deteriorated. In order to prevent this, a scraping member 11 lightly contacts the surface of the supply roller, by which the fine toner or the like is removed from the roller by the rotation of the supply roller, thus maintaining the stabilized function for a long period of time.

In this embodiment, a metal brush lightly and uniformly contacts the roller in the longitudinal direction, and the brush swings by the rotation of the roller to scrape the toner from the supply roller. In place of the metal brush, a metal rod or a metal scraper may be used to lightly contact the roller.

Embodiment 6

Figure 6:
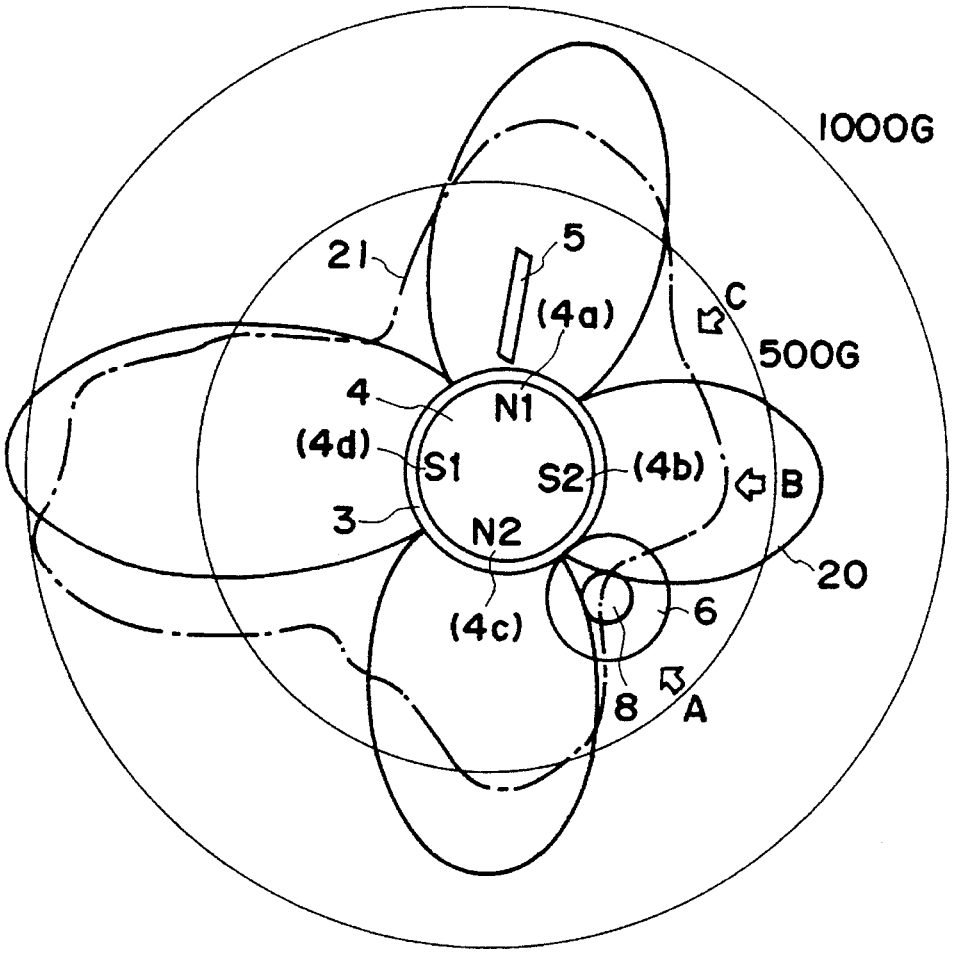
FIG. 6 illustrates magnetic confining force according to an embodiment of the present invention.

A further embodiment will be described, and a detailed description will be provided as to the relationship between the supply roller and the magnetic confining force distribution provided by the magnet in the developing sleeve. FIG. 6 illustrates the developing sleeve, the magnetic blade and the supply roller in this embodiment.

As shown in FIG. 6, the magnetic pole N1 (4*a*) of the magnet 4 in the developing sleeve 3 is substantially opposed to the magnetic blade 5, and as described hereinbefore, it functions to form a thin layer of the magnetic toner on the developing sleeve 3. The magnetic pole S1 (4*d*) of the magnet 4 is substantially opposed to the photosensitive member and functions to return the scattered toner or the fog toner from the photosensitive member. The magnetic pole N2 (4c) of the magnet 4 functions to prevent the leakage of the toner from the developer container.

In the Figure, a solid line 20 indicates the magnetic flux density distribution Br in the radial direction of the sleeve provided by the magnetic pole of the magnet 4. A broken line 21 represents a magnetic force distribution in the radial direction provided on the developing sleeve 3 by the magnet 4. The force is effective to attract the magnetic toner on the developing sleeve in the radial direction, and therefore, it is hereinafter called a magnetic confining force distribution Fr.

For the measurement of the magnetic flux density distribution Br, the use is made of a probe using a hole element which is fixed to the neighborhood of the developing sleeve, and the magnetic flux density is measured by a Gauss meter, while only the magnet is rotated. For the measurement of the magnetic confining force distribution Fr, a small magnetic material ball is fixed to a neighborhood of the developing sleeve, and is joined with a load converter (strain gauge) through a shaft, and the output thereof is read while rotating the magnet.

As will be apparent from the magnetic confining force distribution, the magnetic confining force exhibits local minimum at points A and C and a local maximum at point B in the range from the neighborhood of the magnetic pole N2 to the neighborhood of the magnetic pole N1.

In this embodiment, a supply roller 6 is made of rubber fur brush or is disposed at a position A where the magnetic confining force distribution Fr is a minimum at an upstream side of the magnetic blade. With this arrangement, the supply roller 6 can easily and assuredly scrape the toner remaining on the developing sleeve at a position where the magnetic confining force on the developing sleeve is the least.

By contacting the supply roller 6 to the developing sleeve 3 with this positional relationship, the supply roller 6 exists at a position where the magnetic confining force is the least, and therefore, the remaining toner can be assuredly scraped off the developing sleeve even in the case that the toner is not easily removed from the developing sleeve due to a large amount of the charge of the toner which occurs when the toner scraping force of the supply roller 3 is weakened after the long term operation, when it is in an ambient condition or when the amount of the toner in the developing device is extremely small.

Accordingly, it can be avoided that the charge-up toner remains on the developing sleeve 3, and therefore, the triboelectric charge is stabilized when fresh toner is supplied while removing the remaining toner by the supply roller 6, is stabilized. As a result, the image non-uniformity which may occur when the scraping is insufficient, the toner agglomeration (blotch) on the developing sleeve 3, and the fog due to the instability of the charge application, or the like, can be avoided in the resultant images.

The toner supply to the developing sleeve 3 occurs at a position where the magnetic confining force is strong as at the point B, because the toner supply is affected by the magnetic force as well as by the supply roller 6. At this time, the toner stably charged by the supply roller is deposited on the developing sleeve, and therefore, the replacement with fresh toner does not occur.

The magnetic confining force is also at a minimum at point C, but the supply roller 6 and the magnetic pole N1 (4a) are close, and the magnetic pole N1 (4a) is substantially opposed to the magnetic blade 5, and in addition, the toner is dense here, with the result that the toner is further agglomerated between the magnetic blade 5 and the supply roller 6 by the rotation of the supply roller 6, and the toner deteriorates through long term copying operations with the result of density reduction and the fog production, if the supply roller is disposed here. Therefore, this position is not proper for the supply roller.

For this reason, the positional relationship between the supply roller 6 and the magnetic pole N1 (4a) is preferably such that the supply roller 6 is away from the magnetic pole N1 (4a) upstream with respect to the rotational direction of the developing sleeve and that the supply roller is disposed at a position where the magnetic confining force produced by the magnet 4 is a local minimum.

Through the experiments by the inventors, it has been confirmed that when the supply roller 6 contacts the sleeve at a position adjacent the local minimum point A of the magnetic confining force distribution 21, and the durability test run is carried out under a low humidity condition, good images without image non-uniformity, blotch or fog can be produced.

As a further preferable embodiment, a description will be provided as to the case in which the supply roller is in the form of a unicellular foamed material shown in FIG. 2. It comprises a core metal 8, and a unicellular foamed material of silicone rubber, EPDM rubber, CR rubber, neoprene rubber or the like in which a wall of a cell 9 does not communicate with any adjacent cells. It is rotated in a direction C in FIG. 1, and is in rubbing contact with the developing sleeve 3.

As compared with a open cell roller or a fur brush roller, the surface thereof is dense, and therefore, the effective contact area is increased even if the entrance distance into the developing sleeve is the same. Therefore, by the use of the supply roller of the unicellular foamed rubber material (unicellular roller), both appearing in the case using the magnetic blade can be avoided.

Additionally, the toner is triboelectrically charged to a sufficient extent at a contact portion between the unicellular roller and the developing sleeve, and the charge can be sufficiently retained. For this reason, the insufficiency of the triboelectric charge application to the toner at the regulating portion as compared with the elastic blade when the magnetic blade is used as the regulating member, can be compensated for by the effect of the unicellular roller, and therefore, the amounts of the triboelectric charge are equivalent, and the image quality is good.

Since the roller is made of unicellular material, the toner is not packed into the roller, and therefore, hardening of the roller, wearing, damage or the like due to long term operation, can be avoided, and therefore, the function of the roller can be maintained stably for a long term.

Furthermore, even if foreign matter is introduced into the contact area with the developing sleeve, the foreign matter quickly moves out of the contact area due to the proper degree of unsmoothness provided by the cells on the surface of the roller and the rotation thereof. For this reason, white stripe or the like on the developing sleeve occurring in an elastic blade system does not occur. The proper degree of unsmoothness on the surface improves the toner conveying performance, and therefore, the toner fusing on the roller surface or the developing sleeve surface can be prevented.

As a further preferable example, when the supply roller is in the form of a unicellular roller, the developer regulating member is in the form of a magnetic blade, since then, further durable developing device can be provided.

Nevertheless, the non-uniformity of the image, the blotch or a fog can be prevented in the elastic blade system, and if a further durable elastic blade against wearing of the elastic blade or variation of the contact pressure, is used, a highly durable developing device can be provided.

Figure 7:
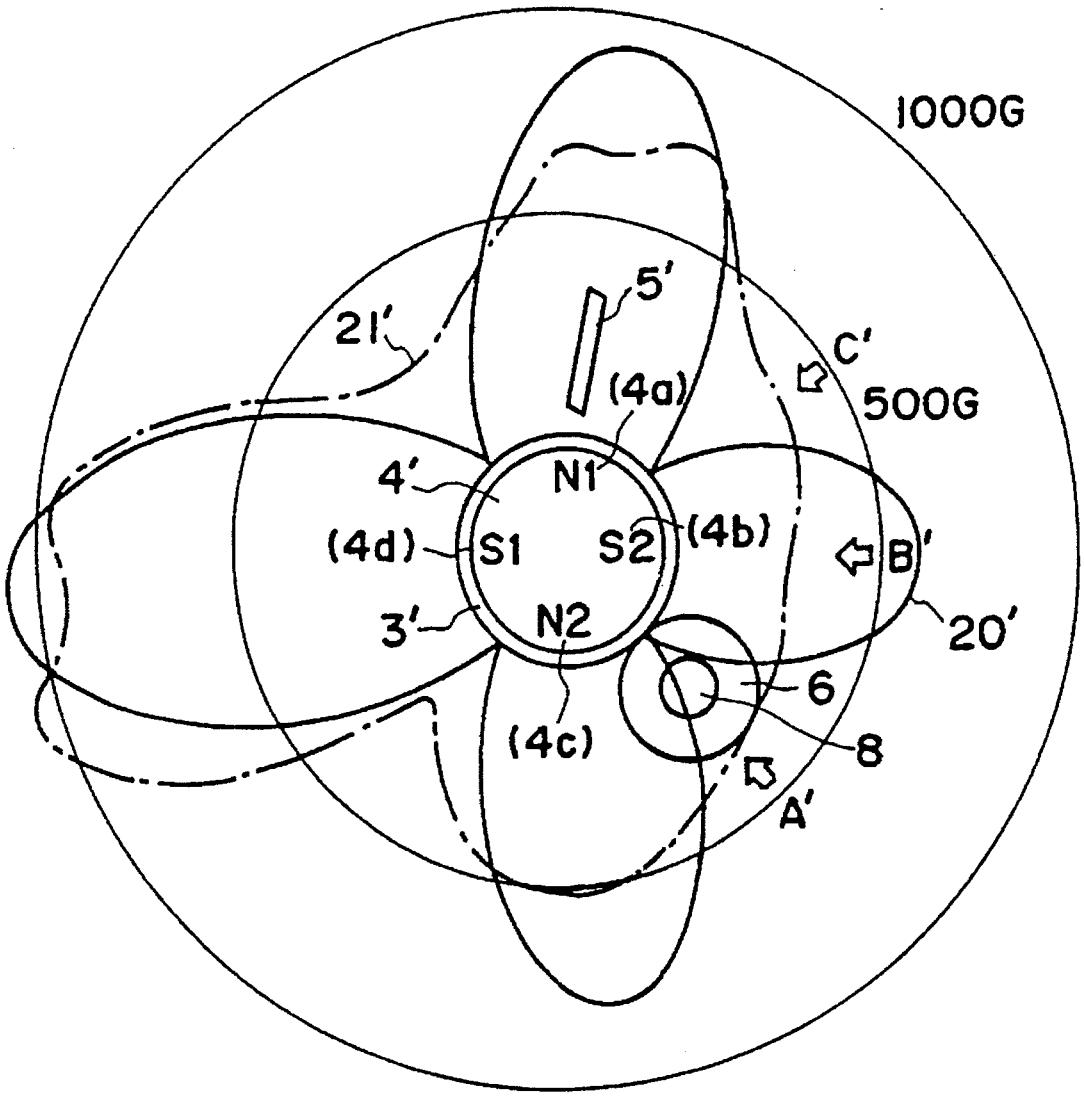
FIG. 7 illustrates another magnetic confining force.

As a comparison example, similar experiments have been carried out using the developing sleeve shown in FIG. 7. As shown in FIG. 7, the magnet 4' in the developing sleeve 3' provides a magnetic flux density distribution in the radial direction of the sleeve, as indicated by the solid line 20'. The magnetic confining force thereby is shown by a broken line 21'. The magnetic force F is proportional to $VB^2$, and therefore, the distribution of the magnetic confining force Fr is not analogous to the Br distribution.

As will be understood from this Figure, the magnetic confining force distribution provided by the magnet does not provide a local minimum in the range from N1 pole to N2 pole. As compared with FIG. 6, the magnetic confining force at point A' of FIG. 7 is approximately twice as large as point A in FIG. 6.

Using a developing sleeve having such a magnetic confining force, the supply roller described above contacts the positions A', B' and C' in FIG. 7, and then the durability test run is carried out under the low temperature condition similar to the first embodiment. Then, when the amount of the toner becomes extremely small in the developing device after the durability test run, an image non-uniformity occurs with significant foggy background when fresh toner is supplied. In addition a small blotch occurs, from which it is understood that the contact position of the supply roller is not proper.

Embodiment 7

A seventh embodiment will be described in which the magnetic flux density of the magnetic pole S2 (4*b*) has a particular relationship with the content of the magnetic material in the magnetic toner. In the first embodiment, the supply roller contacts the developing sleeve adjacent to a position where the magnetic confining force provided by the magnetic is a local minimum for the purpose of scraping the toner off the developing sleeve at a position where the deposition force to the developing sleeve is the smallest. In order to further weaken the toner deposition force, it would be considered that the magnetic flux density of the magnetic pole S2 (4*b*) is decreased or that the content of the magnetic material of the toner is decreased. However, if this is done, the magnetic conveying force for the toner, that is, the circumferential component of the force on the developing sleeve is also reduced, with the result that the toner conveying property is reduced and that the toner is packed between the magnetic pole N2 (4*c*) and the supply roller 6, even to the worst extent in which the toner leaks from the bottom of the developing container. On the other hand, if the magnetic flux density of the magnetic pole S2 (4*b*) is increased, or the content of the magnetic material in the toner is increased, it becomes difficult that the supply roller scrapes the toner off the sleeve.

In this embodiment, the magnetic flux density of the magnetic pole S2 (4*b*) is 300–1000 Gauss, and the magnetic material content in the toner is 30–100 parts (by weight of the basis of 100 parts of the toner resin). By doing so, the above-described problems have been obviated. The same durability test run is carried out as in the first embodiment, and it has been confirmed that good images can be produced without a blotch, density non-uniformity, fog, the density decrease or the like until the end of the last image in the test run.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus, comprising:

a developer carrying member for carrying a magnetic developer;

a regulating member for regulating the layer thickness of the developer on said developer carrying member;

a first magnetic pole, in said developer carrying member, for forming a magnetic field in a regulating position of said regulating member;

a second magnetic pole disposed adjacent to said first magnetic pole upstream thereof with respect to a movement direction of said developer carrying member; and an elastic rotatable member, having a surface layer of foamed material, for supplying a magnetic developer to said developer carrying member, wherein said elastic rotatable member is press-contacted to said developer carrying member between said first magnetic pole and said second magnetic pole at a position closer to said second magnetic pole than said first magnetic pole.

2. An apparatus according to claim 1, wherein said regulating member is comprised of a magnetic member.

3. An apparatus according to claim 1, wherein the magnetic developer is a one component developer.

4. An apparatus according to claim 1, wherein said foamed material has independent pores.

5. An apparatus according to claim 4, wherein said elastic rotatable member has an Asker-C hardness of 8–30 degrees at 300 gf.

6. An apparatus according to claim 4, wherein the density of a surface portion of said elastic rotatable member is 0.15–0.35 $g/cm^3$.

7. An apparatus according to claim 4, wherein the number of cells of the foamed material is 100–400/inch.

8. An apparatus according to claim 1, wherein said elastic rotatable member rubs said developer carrying member.

9. An apparatus according to claim 1, wherein the unicellular foamed material has a triboelectric charging property which is opposite from that of the developer.

10. A developing apparatus comprising:

a developer carrying member for carrying a magnetic developer;

a regulating member for regulating the thickness of a layer of the developer on said developer carrying member;

a first magnetic pole in said developer carrying member, for forming a magnetic field at a regulating position of said regulating member;

a second magnetic pole having a polarity opposite from said first magnetic pole which is disposed first toward upstream from said first magnetic pole with respect to a movement direction of said developer carrying member;

wherein the magnetic flux density of said first magnetic pole is substantially equal to or larger than that of said second magnetic pole, and an elastic rotatable member press-contacted to said developer carrying member at a position upstream of said first magnetic pole and downstream of said second magnetic pole with respect to said movement direction.

11. An apparatus according to claim 10, wherein a surface of said elastic rotatable member is composed of a foamed material.

12. An apparatus according to claim 11, wherein said foamed material is a unicellular material.

13. An apparatus according to claim 10, wherein said regulating member includes a magnetic member.

14. An apparatus according to claim 10, wherein said elastic rotatable member is press-contacted to said developer carrying member.

15. An apparatus according to claim 10, wherein said elastic rotatable member rubs said developer carrying member.

16. An apparatus according to claim 10, wherein the foamed material has a triboelectric charging property which is opposite from that of the developer.

17. A developing apparatus comprising:

a developer carrying member for carrying a magnetic developer;

a plurality of magnetic poles in said developer carrying member; and a developer supplying rotatable member for supplying the magnetic developer onto said developer carrying member, wherein said developer supplying rotatable member is disposed adjacent a position where a magnetic confining force on said developer carrying member is a local minimum.

18. An apparatus according to claim 17, wherein said rotatable member contacts said developer carrying member.

19. An apparatus according to claim 18, wherein said rotatable member includes a fur brush.

20. An apparatus according to claim 17, wherein said rotatable member has a foamed material at the surface thereof, and the foamed material is press-contacted to said developer carrying member.

21. An apparatus according to claim 20, wherein said foamed material is a unicellular material.

22. An apparatus according to claim 17, further comprising a regulating member for regulating the layer thickness of the developer on said developer carrying member disposed opposed to said magnetic pole, downstream of said supply rotatable member with respect to a movement direction of said developer carrying member.

23. An apparatus according to claim 22, wherein said regulating member includes a magnetic member.

24. An apparatus according to claim 17, wherein the magnetic developer is a one component developer.

25. An apparatus according to claim 17, wherein said developer supplying rotatable member is an elastic rotatable member rubbing said developer carrying member.

26. An apparatus according to claim 17, wherein a surface of said supply rotatable member has a triboelectric charging property which is opposite from that of the developer.

27. An apparatus according to claim 17, further comprising a scraping member for scraping the developer off said supply rotatable member.

* * * * *

UNITED STATES PATENT AND TRADEMARK OFFICE

CERTIFICATE OF CORRECTION

PATENT NO. : 5,621,505

DATED : April 15, 1997

INVENTOR(S) : YOSHIAKI KOBAYASHI, ET AL.

It is certified that error appears in the above-indentified patent and that said Letters Patent is hereby corrected as shown below:

COLUMN 1

Line 24, "developer," should read --developer--.
Line 38, "point," should read --point--.
Line 44, "are" should read --is--.

COLUMN 2

Line 23, "or" should read --for--.
Line 27, "member an" should read --member, and--.
Line 54, "supply" should read --supplying--.

COLUMN 4

Line 22, "generating" should read --generating a--
Line 64, "zone," should read --zone--.

COLUMN 5

Line 25, "therefrom," should read --therefrom--.
Line 35, "member," should read --member--.
Line 40, "operation," should read --operation--.

UNITED STATES PATENT AND TRADEMARK OFFICE

CERTIFICATE OF CORRECTION

PATENT NO. : 5,621,505 Page 2 of 3

DATED : April 15, 1997

INVENTOR(S) : YOSHIAKI KOBAYASHI, ET AL.

It is certified that error appears in the above-indentified patent and that said Letters Patent is hereby corrected as shown below:

COLUMN 6

Line 16, "charged," should read --charged--.

COLUMN 8

Line 15, "onto" should read --onto the--.
Line 63, "tuner" should read --toner--.

COLUMN 9

Line 30, "dues" should read --does--.

COLUMN 10

Lines 36 and 37, "tens thousand" should read --tens of thousands of--.

COLUMN 11

Line 22, "local" should read --a local--.

UNITED STATES PATENT AND TRADEMARK OFFICE

CERTIFICATE OF CORRECTION

PATENT NO. : 5,621,505 Page 3 of 3

DATED : April 15, 1997

INVENTOR(S) :

YOSHIAKI KOBAYASHI, ET AL.

It is certified that error appears in the above-indentified patent and that said Letters Patent is hereby corrected as shown below:

COLUMN 12

Line 29, "a open" should read --an open--.
Line 65, "further" should read --a further--.
Line 66, "the blotch" should read --a blotch--.
Line 67, "a fog" should read --the fog--.

COLUMN 13

Line 39, "magnetic" should read --magnetic material--.

Signed and Sealed this

Twenty-fourth Day of February, 1998

*Attest:*

Bruce Lehman

BRUCE LEHMAN

*Attesting Officer*

*Commissioner of Patents and Trademarks*